US006447264B1

(12) United States Patent
Lucas et al.

(10) Patent No.: US 6,447,264 B1
(45) Date of Patent: Sep. 10, 2002

(54) COMPRESSOR SYSTEM

(75) Inventors: Michael J. Lucas, Mooresville; Timothy F. Daley, Cornelius, both of NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/777,210

(22) Filed: Feb. 5, 2001

(51) Int. Cl.[7] ..... S04B 53/00

(52) U.S. Cl. ..... 417/313; 417/234; 417/312; 417/201; 417/423.8

(58) Field of Search ..... 417/234, 312, 417/201, 423.8

(56) References Cited

U.S. PATENT DOCUMENTS 3,989,415 A * 11/1976 Van-Hee et al. ..... 181/224
4,264,282 A * 4/1981 Crago ..... 181/202
4,492,533 A 1/1985 Tsuge
4,585,398 A 4/1986 Drake
4,902,226 A 2/1990 Elliott et al.
4,976,098 A 12/1990 Meyer et al.
5,151,016 A 9/1992 Her
5,240,648 A 8/1993 Gill et al.
5,507,618 A 4/1996 Kubo et al.
5,672,052 A * 9/1997 Ishida et al. ..... 181/202

* cited by examiner

*Primary Examiner*—Charles G. Freay
*Assistant Examiner*—Emmanuel Sayoc
(74) *Attorney, Agent, or Firm*—Michael Best & Friedrich LLP

(57) ABSTRACT

A compressor system having a first compartment for housing relatively quietly operating equipment, and a second compartment for housing relatively noisy operating equipment. The second compartment is substantially closed off from the surrounding atmosphere to reduce the amount of noise that can be heard outside the compressor system on account of the noisy equipment operating within the compressor system housing. The second compartment includes a small air inlet opening and a small air outlet opening to allow enough air to flow through the second compartment to cool the equipment housed therein. The small openings reduce the amount of air-born noise which is released to the outside environment. The compressor system also has an air intake directing device for directing an appropriate amount of air into the second compartment to cool the noise generating machinery located within the second compartment, and for directing an appropriate amount of air to an air inlet opening of a compressor, thereby more efficiently using the air drawn into the compressor system housing.

35 Claims, 9 Drawing Sheets

COMPRESSOR SYSTEM

FIELD OF THE INVENTION

The present invention relates generally to compressor systems and, more particularly, to air compressor systems.

BACKGROUND OF THE INVENTION

Conventional air compressors typically include a compressor, a motor to drive the compressor and an air and oil cooling system to cool the compressed air and lubricating oil. Conventional air compressors are usually enclosed within a housing. A blower, fan or the like draws air into or pushes air through an opening in the housing. Some of the air which enters the housing is drawn into the compressor for ultimate use and the remaining portion of the air passes through the housing to cool the compressor, the motor, the air and oil cooling system, and other components before being discharged from the housing.

FIG. 1 schematically illustrates a conventional compressor system 10. The compressor system 10 includes a housing 14 having an air intake opening 18 and an air outlet opening 22. A compressor (i.e., airend) and a motor or drive train operatively connected to the compressor are housed within the housing 14. A fan 26 is positioned downstream from the airend of the compressor and motor to draw air in through the air intake opening 18. Some of the air drawn into the housing is compressed in the airend of the compressor and some of the air flows over the compressor and motor to cool the compressor and motor. The fan 26 also pushes the air through a plenum box 30 which is used to distribute the air over an air and oil cooler 34 before pushing the air out of the air outlet opening 22.

SUMMARY OF THE INVENTION

A problem with the known compressor system described above is the large amount of noise that emanates from the openings in the housing. The air flowing through the housing to cool the compressor and motor flows, for the most part, in a linear path from the air intake opening in the housing through the air outlet opening in the housing. Noise generated by the compressor and motor is freely emitted through the openings in the housing because there is no significant obstruction or other sound reducing means within the housing to reduce the amount of noise which can be carried out of the housing. Thus, there is a need for a new compressor system that significantly reduces the amount of noise which emanates from air inlet and outlet openings provided in the compressor system housing.

A feature of the present invention is to provide a compressor system having a housing which includes separate compartments. A first compartment houses an air and oil cooling system for the compressed air and lubricating oil. A second compartment houses a compressor and motor which generate most of the operating noise of the compressor system. A large portion of air drawn in through an air intake opening of the housing is directed to cool the air and oil cooling system positioned in the first compartment. A smaller portion of air drawn in through the air intake opening of the housing is directed into the second compartment to cool the compressor and motor. According to the principles of the present invention and contrary to conventional wisdom, it has been determined that only a small portion of the air drawn into the housing is actually needed to sufficiently cool the compressor and motor. Thus, the second compartment is substantially closed, except for a first limited opening to allow the required amount of cooling air in and a second limited opening to allow the cooling air to exit. The compressor and motor are substantially isolated from the air intake opening and air outlet opening in the housing, thereby reducing the amount of noise generated by the compressor and motor that would normally emanate out such openings. Limiting the amount of cooling air which flows over the noise generating compressor and motor also reduces the amount of air-born noise which can exit out of the openings of the housing.

Another feature of the present invention is to provide a compressor system which regulates the amount of air fed to the compression chamber of a compressor, the amount of air used to cool an air and oil cooling system for the compressed air and lubricating oil, and the amount of air which cools the compressor and motor, all for the purpose of reducing the amount of noise emitted from an air intake opening and an air outlet opening in the housing of the compressor system. Thus, the present invention provides in one aspect thereof, an air directing device which receives a stream of air flowing through an air intake opening in the compressor system housing. A portion of air drawn in through the air intake opening of the housing is caused to cool the air and oil cooling system for the compressed air and lubricating oil. Another portion of air drawn in through the air intake opening of the housing is separated into two streams of air by the air directing device. The first separated stream of air is fed to a compression chamber of the compressor. The second separated stream of air is directed through a non-linear path to flow over the compressor and motor to cool the compressor and motor, and then out of the air outlet opening in the housing. Because only a small portion of the air entering the compressor system housing is actually used to cool the compressor and motor, and because the air used to cool the compressor and motor travels in a non-linear path through the compressor housing, the amount of noise generated by the compressor and motor that emanates from the openings in the compressor housing is greatly reduced, as compared to conventional compressor systems.

Other features and advantages of the invention will become apparent to those skilled in the art upon review of the following detailed description, claims and drawings in which like numerals are used to designate like features.

Figure 1:
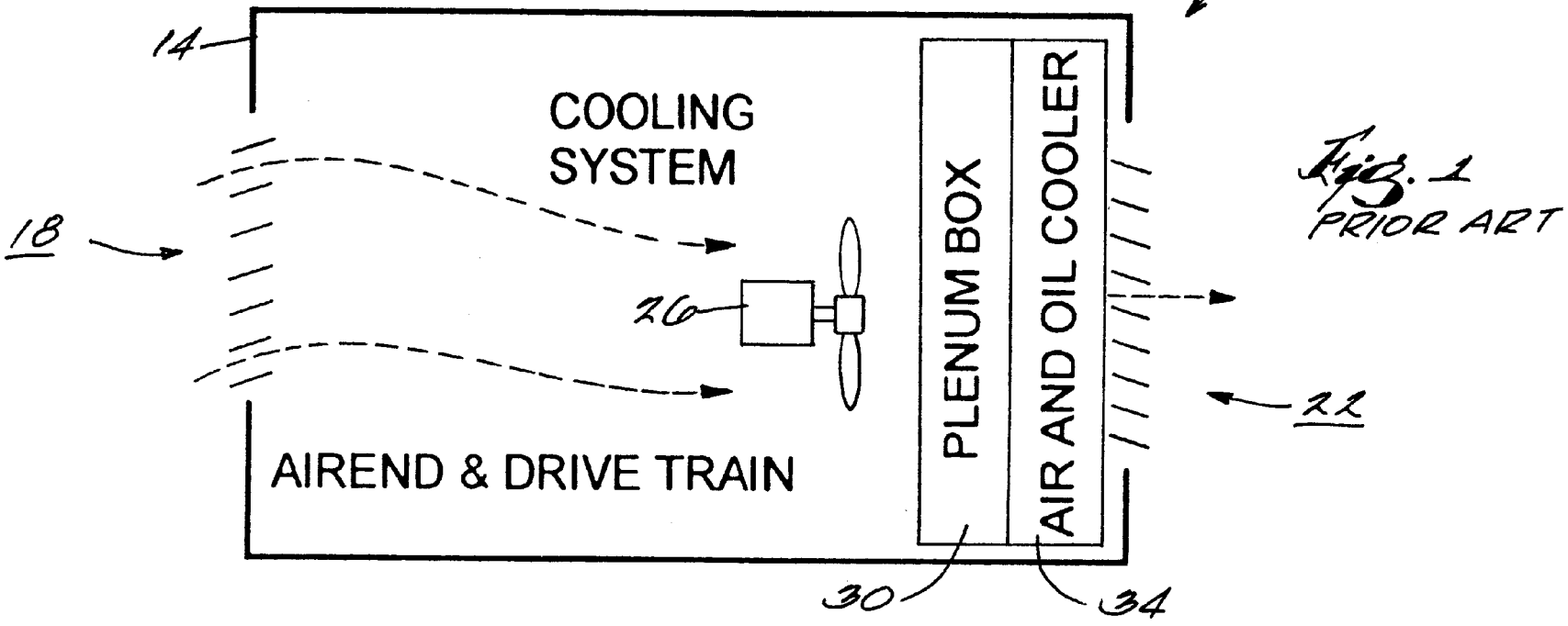
Fig. 1 PRIOR ART
FIG. 1 is a schematic illustration of a conventional compressor system.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE PREFERRED EMBODIMENT

Figure 2:
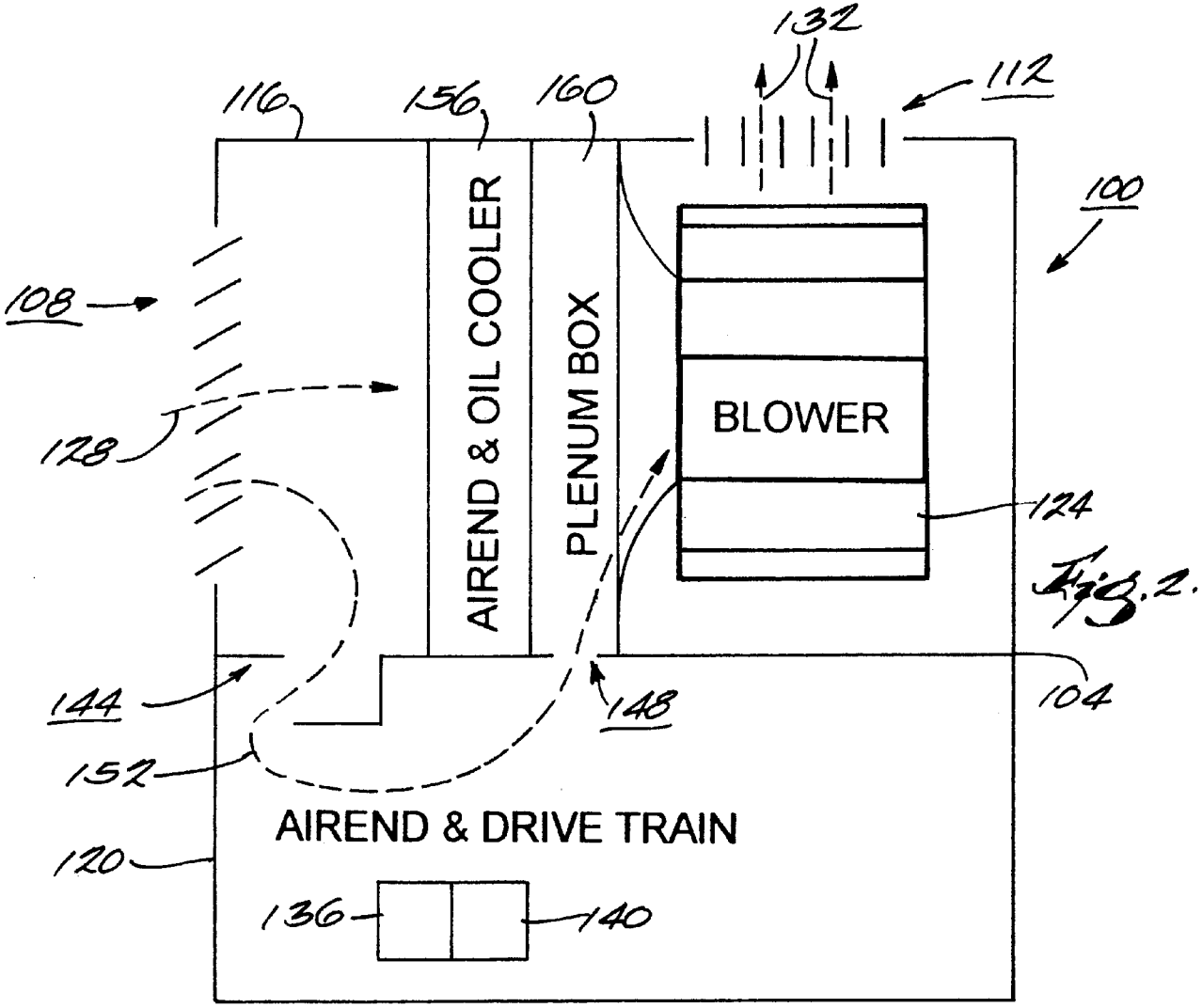
FIG. 2 is a schematic illustration of a compressor system embodying the present invention.

FIG. 2 schematically illustrates a compressor system 100 embodying the present invention. As explained above, a feature of the present invention is to provide a compressor system having reduced noise emission during operation. Another feature of the present invention, is to provide a compressor system which better utilizes the air drawn into the compressor system for actual use and for cooling purposes.

The compressor system 100 includes a housing 104 having an air intake opening 108, an air outlet opening 112, a first compartment 116, and a second compartment 120. A blower 124 positioned within the first compartment 116 draws air through the air intake opening 108 (shown by arrow 128), through the first compartment 116, and discharges the air out of the air outlet opening 112 (shown by arrows 132). A compressor 136 having an airend, and a motor or drive train 140 operatively connected to the compressor are positioned within the second compartment 120. The second compartment 120 is substantially closed from the atmosphere outside the compressor system 100, except for a restricted first air inlet opening 144 which communicates with the air intake opening 108 of the housing 104, and a restricted second air outlet opening 148 which communicates with the blower 124. The blower 124 draws air through the air inlet opening 144, through the second compartment 120, through the air outlet opening 148 (shown by arrow 152), and discharges the air out of the air outlet opening 112 of the housing 104. The air flowing through the second compartment 120 cools the compressor 136 and motor 140. The compressor 136 and motor 140 are isolated from the main air flow which flows through the first compartment 116 of the compressor system 100, such that the noise generated by the compressor 136 and motor 140 is substantially contained within the second compartment 120. In addition, the air flows in a non-linear or curved path through the air inlet opening 144, through the second compartment 120, and out of the air outlet opening 148 to further reduce the amount of air-born noise that escapes out of the second compartment 120. In other words, unlike conventional compressor systems which do not provide sound obstructing material between an air intake opening and an air outlet opening in the housing to reduce the amount of noise which emanates from the openings, the boundaries of the second compartment 120 and the non-linear path of the air flow into and out of the second compartment 120, provide a sound barrier for the noise generated by the compressor 136 and motor 140 located within the second compartment 120.

It is contemplated that the compressor system 100 schematically illustrated in FIG. 2 could have other configurations, so long as the compressor 136 and motor 140 are isolated or spaced away from the air intake opening 108 and the air outlet opening 112, and so long as the cooling air which flows over the compressor 136 and motor 140 does not flow in a substantially linear path from the air intake opening 108 through the air outlet opening 112. It is also contemplated that the compressor 136 may be any suitable compressor, however, for the purposes of the preferred embodiment, the compressor 136 is an oil-flooded air compressor. As generally known, the oil fed into the compressor 136 must be removed from the stream of compressed air before the compressed air may be used downstream for pneumatic equipment and/or other tools. Normally, it is desirable to cool the compressed air before it is sent on for ultimate use, and to also cool the oil separated from the compressed air before it is fed back to the compressor 136. Accordingly, as shown in FIG. 2, an air and oil cooler or heat exchanger 156 for the compressed air and lubricating oil is provided. According to one embodiment of the present invention, the heat exchanger 156 is positioned within the first compartment 116 adjacent to the air intake opening 108. The blower 124 draws air through the heat exchanger 156 to cool the compressed air and lubricating oil traveling therethrough.

According to another embodiment of the present invention, an air plenum box 160 is positioned within the first compartment 116 between the heat exchanger 156 and the blower 124 to distribute the air passing therethrough. In a preferred embodiment, the air outlet opening 148 in the second compartment 120 is an aperture in the air plenum box 160. The blower 124 causes the pressure within the air plenum box 160 to be less than atmospheric pressure. A majority of the air drawn into the housing 104 by the blower 124 flows through the first compartment 116 to cool the heat exchanger 156, into the low pressure air plenum box 160, through the blower 124, and then out of the air outlet opening 112 in the housing 104. A smaller percentage of the air drawn into the housing 104 by the blower 124 flows through the second compartment 120 to cool the compressor 136 and motor 140, into the low pressure plenum box 160, through the blower 124, and then out of the air outlet opening 112 in the housing 104.

Figure 3:
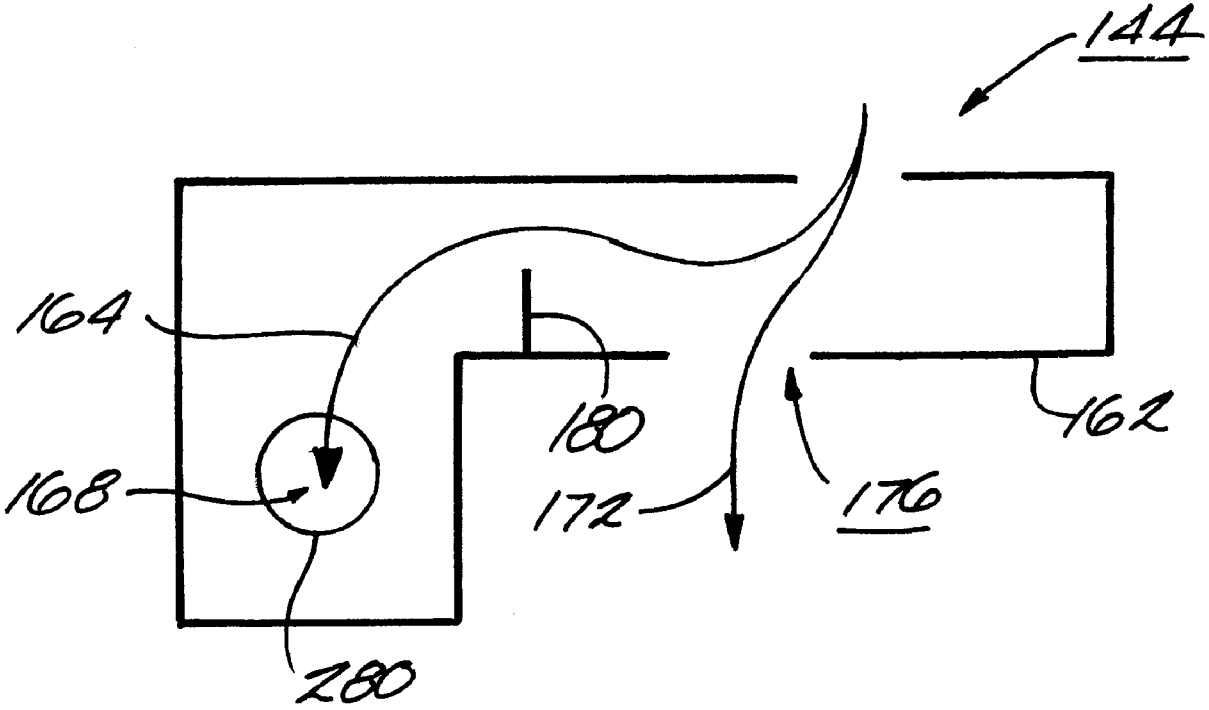
FIG. 3 is a schematic illustration of an air directing device according to one aspect of the present invention.

In an alternative embodiment, as illustrated in FIG. 3, the air inlet opening 144 of the second compartment 120 can be an opening for an air directing device 162. The air directing device 162 includes a first air flow channel (shown by arrow 164) for a first stream of air to be discharged from a first air exit opening 168 into an air inlet opening (not shown) of the compressor 136, and a second air flow channel (shown by arrow 172) for a second stream of air to be discharged from a second air exit opening 176 into the second compartment 120 to cool the compressor 136 and motor 140. Preferably, a partition 180 is provided in the flow path 164 to regulate the amount of air flowing through the flow path 164. The openings 144, 168, 176, and 148 (FIG. 2), and the restricted flow passageway created by the partition 180, are sized to provide a flow of air through the second compartment 120 to prevent the compressor 136 and motor 140 from overheating, and to ensure that the right amount of air flows into the air inlet opening of the compressor 136 so that the compressor 136 does not starve because of a lack of air.

Figure 4:
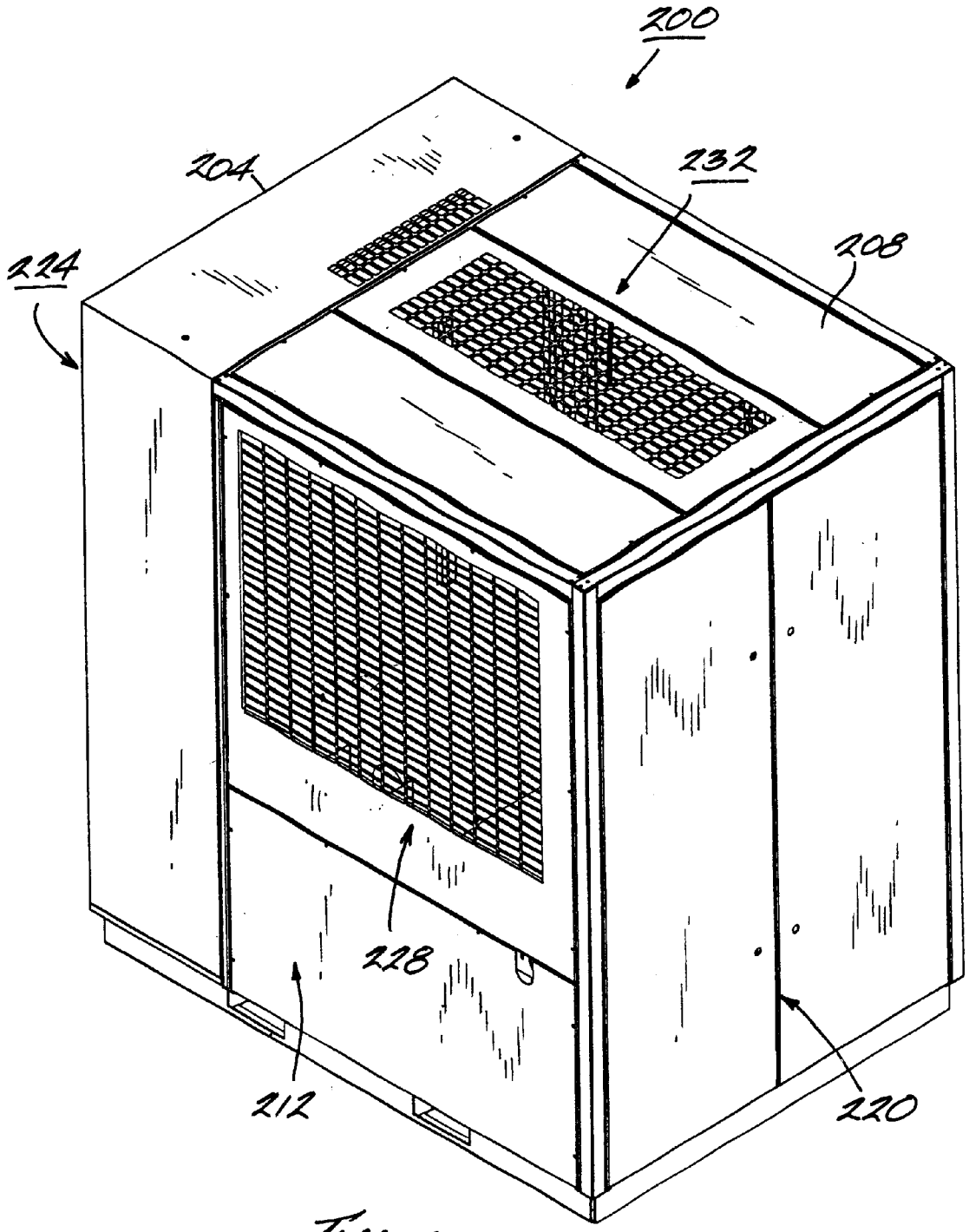
FIG. 4 is a perspective view showing the top, back and right side panels of the compressor system housing according to the present invention.
Figure 5:
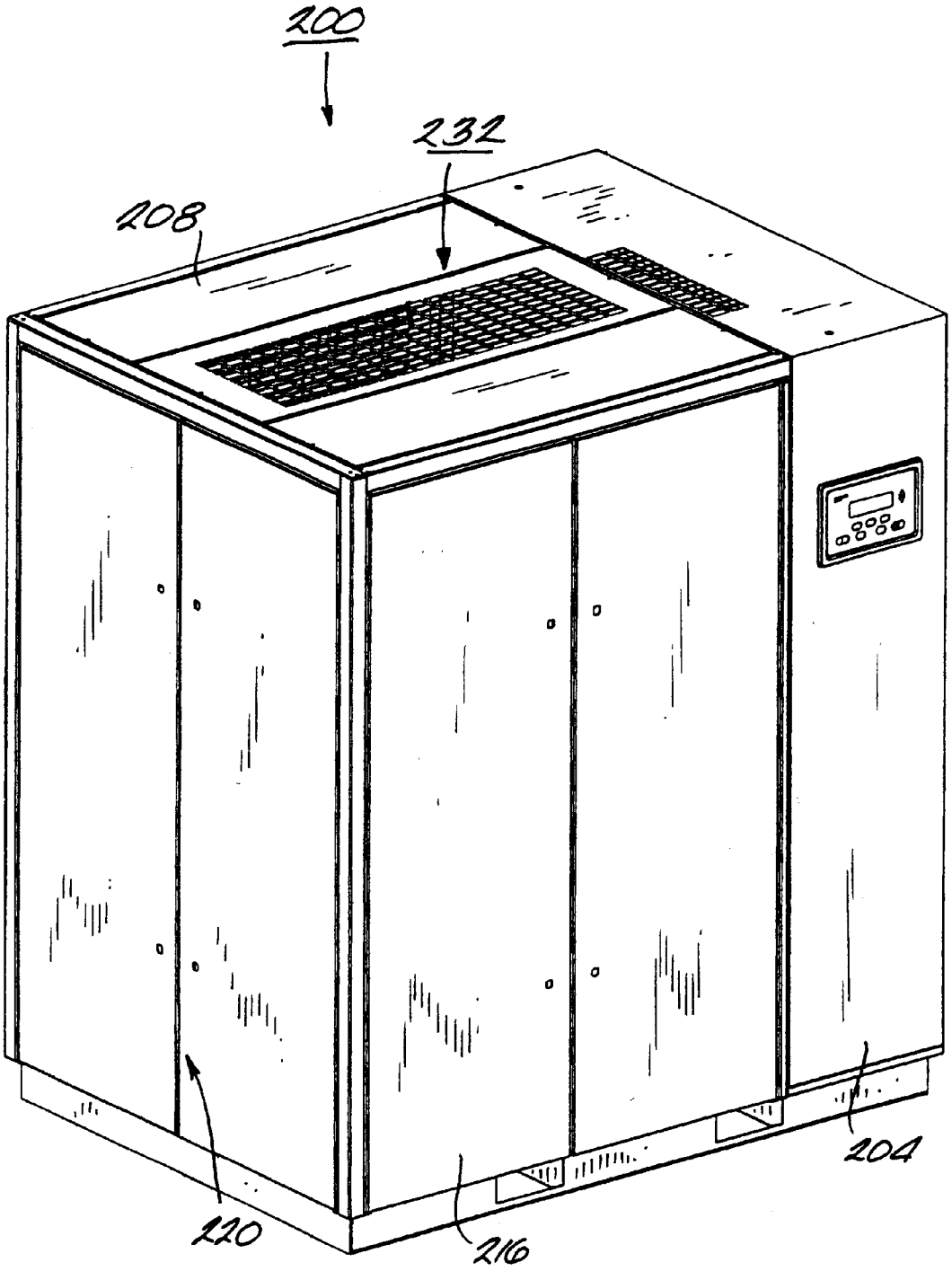
FIG. 5 is a perspective view showing the top, front and right side panels of the compressor system housing according to the present invention.
Figure 6:
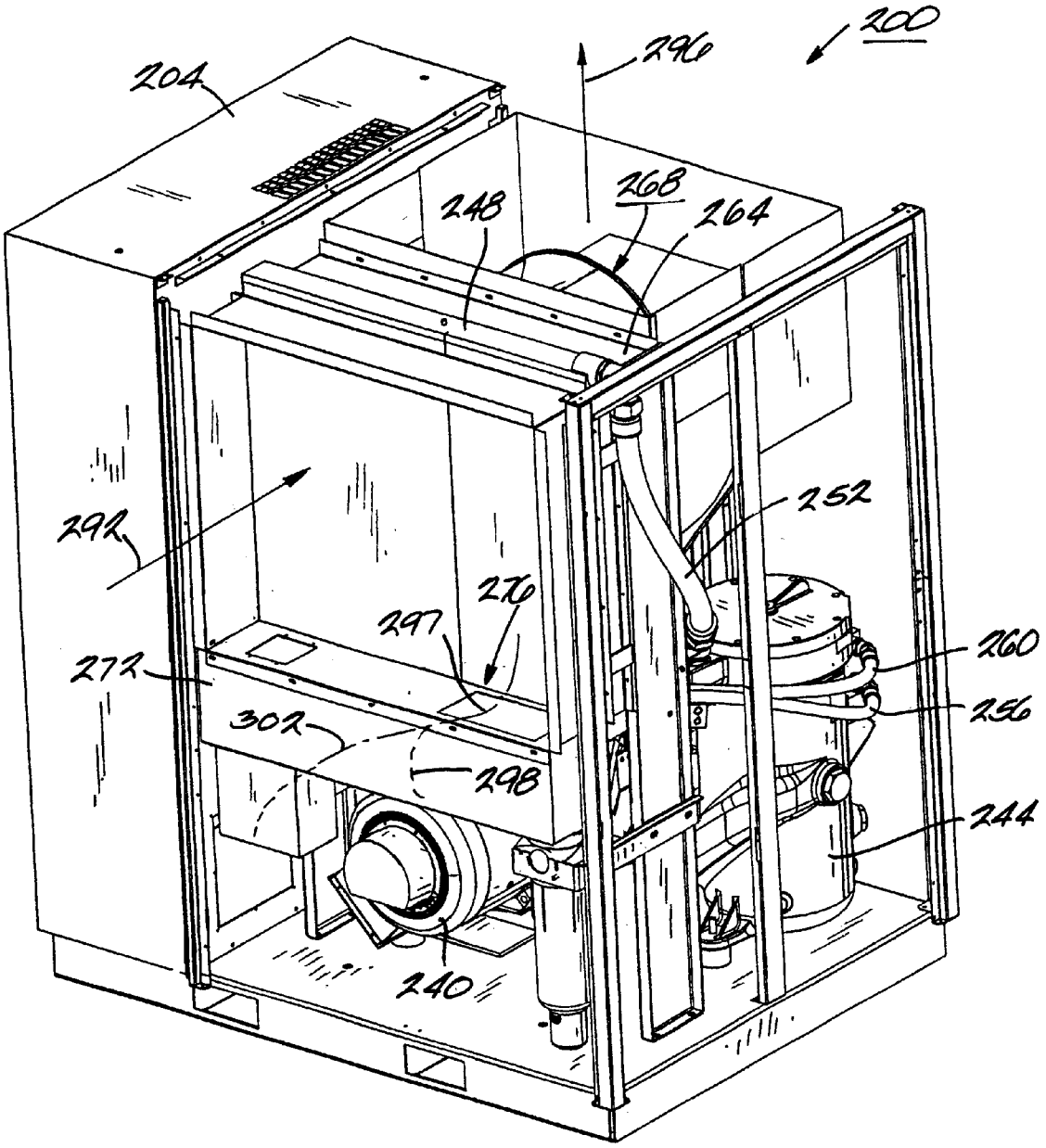
FIG. 6 is a perspective view of the compressor system according to the present invention with the top, back and right side panels shown in FIG. 4 removed.
Figure 7:
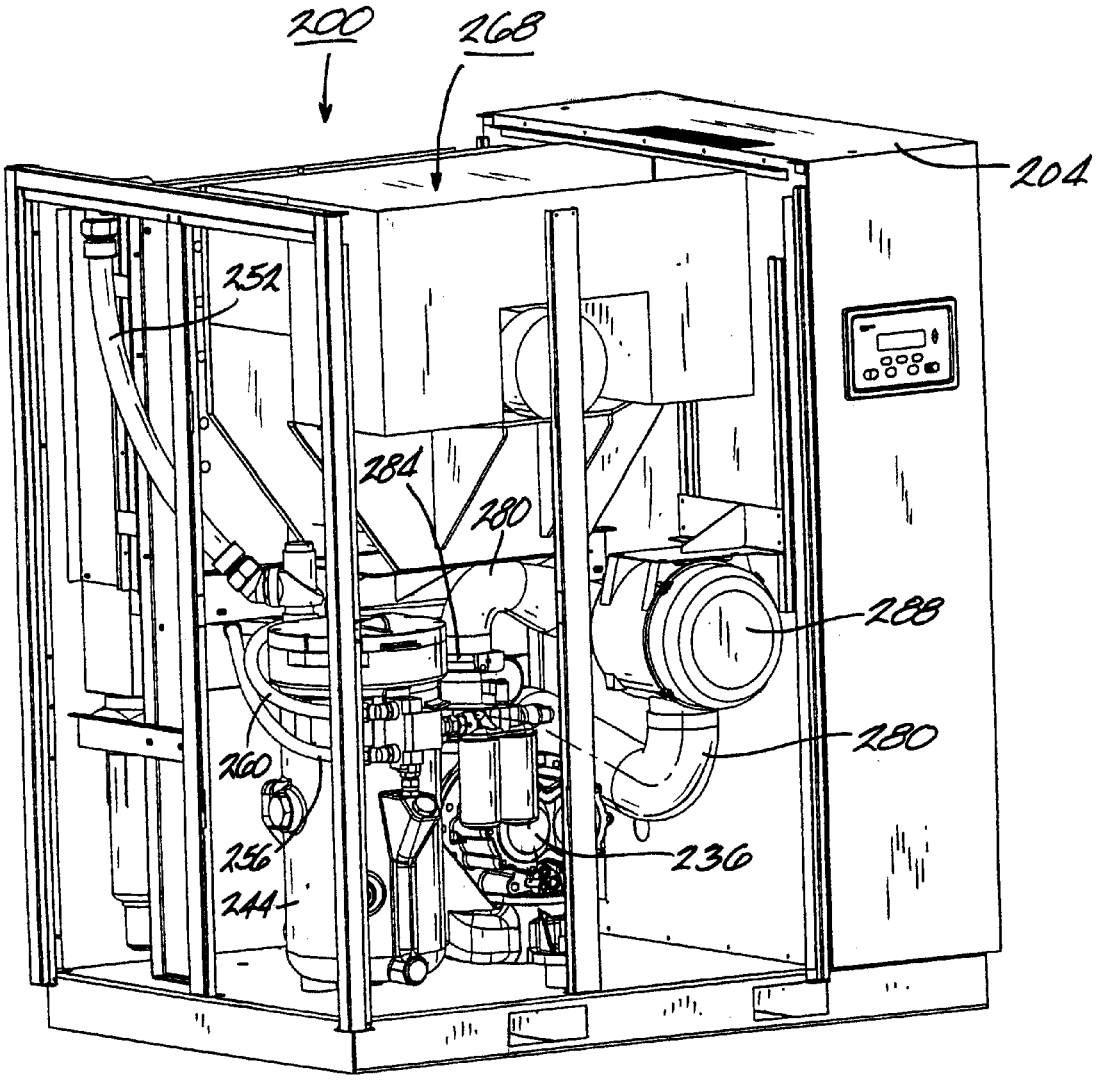
FIG. 7 is a perspective view of the compressor system according to the present invention with the top, front and right side panels shown in FIG. 5 removed.
Figure 8:
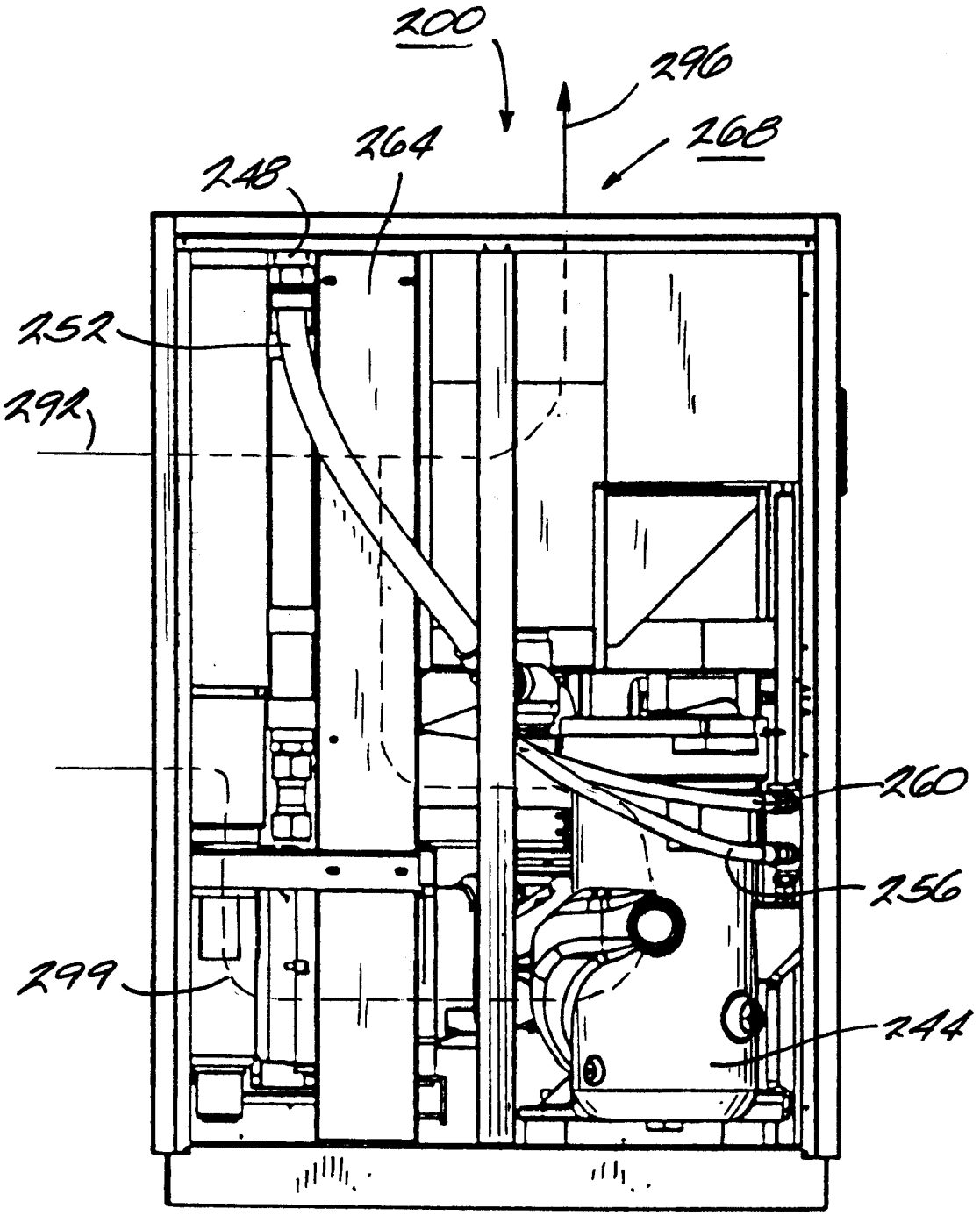
FIG. 8 is a right side plan view of the compressor system of FIGS. 6–7 with the right side panel shown in FIGS. 4–5 removed.
Figure 9:
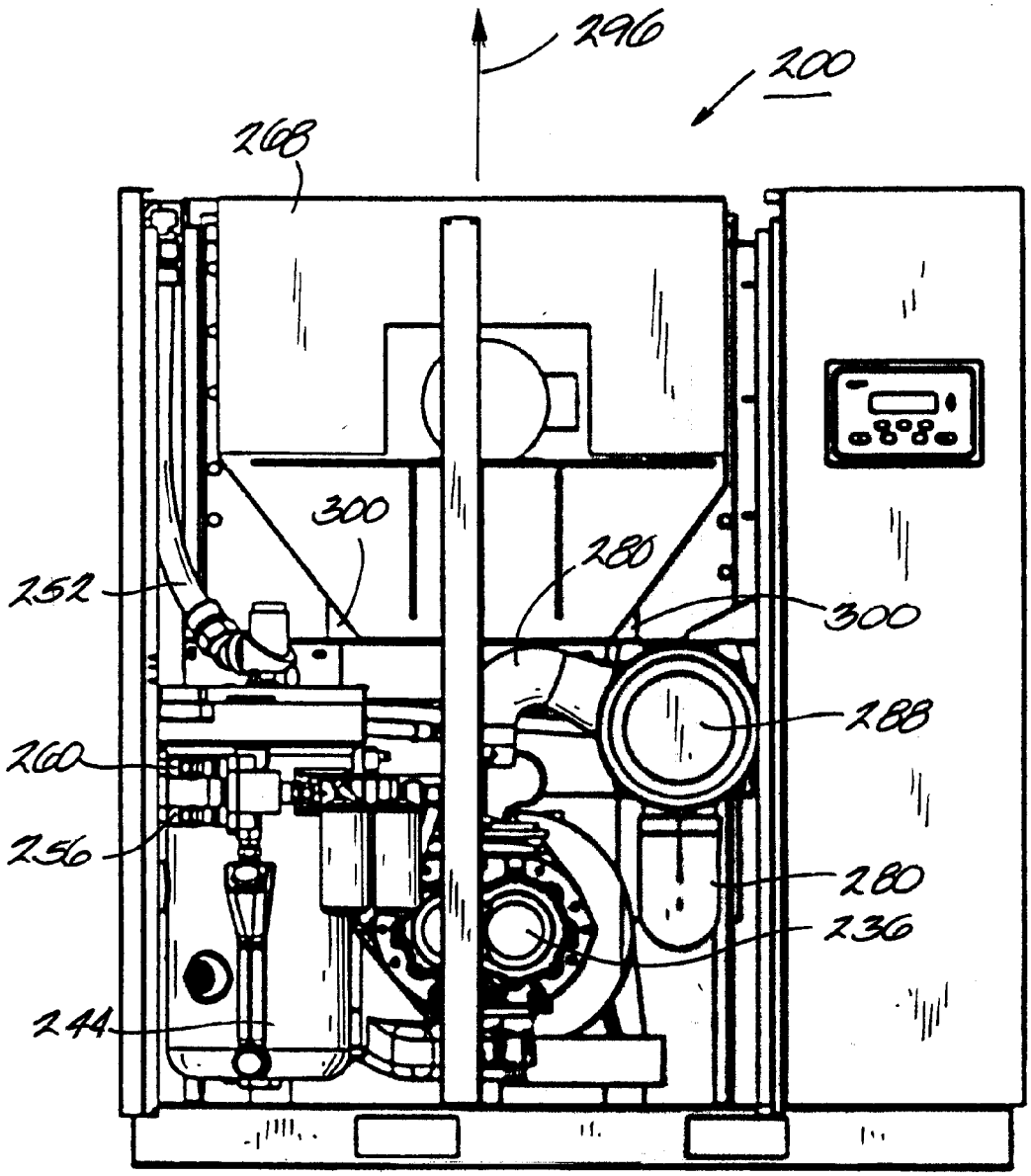
FIG. 9 is a front side plan view of the compressor system of FIGS. 6–7 with the front side panel shown in FIG. 5 removed.

In conjunction with the description associated with the compressor system 100 of FIGS. 2–3, FIGS. 4–9 illustrate a preferred compressor system 200. Referring to FIGS. 4–5, the compressor system 200 includes a housing 204 having a top side panel 208, a back side panel 212, a front side panel 216, a right side panel 220, and a left side panel 224. An air intake opening 228 is provided in the back side panel 212, and an air outlet opening 232 is provided in the top side panel 208. Referring to FIGS. 6–9, the top 208, back 212, front 216, and right 220 side panels have been removed to show the inner compartments and equipment of the compressor system 200.

The compressor system 200 includes a compressor 236 (FIGS. 7 and 9), a motor 240 (FIG. 6) operatively connected to the compressor 236, a separator tank 244 (FIGS. 6–9) in fluid flow communication with the compressor 236 for separating the compressed air and oil from the air/oil mixture received from the compressor 236, an air and oil cooler 248 (FIGS. 6 and 8) for cooling the compressed air received from separator tank 244 via hose 252 (FIGS. 6–9) and for cooling the oil received from the separator tank 244 via hose 256 (FIGS. 6–9), a hose 260 (FIGS. 6–9) for transporting the cooled lubricant oil from the air and oil cooler 248 back to the compressor 236, an air plenum box 264 (FIGS. 6 and 8), and a blower device 268 (FIGS. 6–9).

The compressor system 200 further includes an air intake directing device or enclosure 272 (FIG. 6 and see also 162 in FIG. 3) removably mounted within the housing 204. The air intake enclosure 272 includes an air inlet opening 276 (FIG. 6 and see also 144 in FIG. 3) to receive a stream of air flowing through the air intake opening 228 (FIG. 4) of the housing 204. The air intake enclosure 272 includes a first air flow channel 164 (FIG. 3) between the air inlet opening 276 and a first air exit opening 168 (FIG. 3), and a second air flow channel 172 between the air inlet opening 276 and a second air exit opening 176 (FIG. 3). The air intake enclosure 272 is preferably lined with sound absorbing material to reduce the amount of noise which may travel therethrough. A tube or hose 280 (FIGS. 7 and 9, and see also FIG. 3) is connected to the first air exit opening 168 of the air intake enclosure 272 and an air inlet opening 284 (FIG. 7) of the compressor 236. Preferably, an air filter 288 (FIGS. 7 and 9) communicates with the tube 280 to filter the air before it enters the compressor 236.

Having described most of the components of the compressor system 200, certain features of the present invention are explained as follows. The blower 268 draws air in through the air intake opening 228 of the housing 204 (shown by arrow 292 in FIGS. 6 and 8) to cool the air and oil cooler 248. The blower 268 draws the air through the air and oil cooler 248, into the air plenum box 264, and then blows the air out of the air outlet opening 232 of the housing 204 (shown by arrow 296 in FIGS. 6 and 8–9). The blower 268 also draws air in through the air inlet opening 276 of the air intake enclosure 272 (shown by dashed line 297 in FIG. 6), out the second air exit opening 176 in the air intake enclosure 272 (shown by dashed line 298 in FIG. 6), over the compressor 236 and motor 240 to cool the compressor 236 and motor 240 (shown by dashed line 299 in FIG. 8), through an aperture 300 (FIG. 9) provided in the air plenum box 264, into the air plenum box 264 (see FIG. 8), and then blows the air out of the air outlet opening 232 of the housing 204 (see FIG. 8). Some of the air drawn into the air inlet opening 276 of the air intake enclosure 272 flows through the first air flow channel 164 (shown by dashed line 302 in FIG. 6). The stream of air flowing through the air flow channel 164 exits the first air exit opening 168 in the air intake enclosure 272, flows through the hose 280 and air filter 288, and into the air inlet opening 284 of the compressor 236.

Variations and modifications of the foregoing are within the scope of the present invention. For example, although a blower has been described to cause air to flow through the compressor system, a fan or the like could be used. As another example, although the air intake directing device has been described as being a silencer box or enclosure, the air intake directing device could comprise a series of baffles to direct the appropriate amount of air to the compressor for compression and to the compressor compartment for cooling purposes. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A compressor system comprising:

a housing having an air intake opening and an air outlet opening;

an air intake directing device to receive a stream of air flowing through said air intake opening of said housing, said air intake directing device including a first air exit opening for discharging a first stream-of air and a second air exit opening for discharging a second stream of air; and a compressor housed within said housing, said compressor including an air inlet opening to receive the first stream of air flowing out of said first air exit opening of said air intake directing device said first stream of air being compressed in said compressor and said compressor being cooled by the second stream of air which flows out of said second air exit opening of said air intake directing device, the second stream of air then flowing out of said air outlet opening in said housing.

2. A compressor system comprising:

a housing having an air intake opening and an air outlet opening;

an air intake directing device to receive a stream of air flowing through said air intake opening of said housing, said air intake directing device including a first air exit opening for discharging a first stream of air and a second air exit opening for discharging a second stream of air, wherein said air intake directing device is a box shaped enclosure which is removably mounted within said housing; and a compressor housed within said housing, said compressor including an air inlet opening to receive the first stream of air flowing out of said first air exit opening of said air intake directing device, and said compressor being cooled by the second stream of air which flows out of said second air exit opening of said air intake directing device, the second stream of air then flowing out of said air outlet opening in said housing.

3. A compressor system according to claim 1, wherein said air intake directing device includes an air channel having at least one curved air flow path.

4. A compressor system according to claim 1, wherein said air intake directing device includes an air inlet opening, a first air flow channel between said air inlet opening and said first air exit opening, and a second air flow channel between said air inlet opening and said second air exit opening.

5. A compressor system according to claim 4, wherein at least one of said first air flow channel and said second air flow channel of said air intake directing device includes a restricted air flow passage at least partially created by a partition.

6. A compressor system comprising:

a housing having an air intake opening and an air outlet opening;

an air intake directing device to receive a stream of air flowing through said air intake opening of said housing, said air intake directing device including a first air exit opening for discharging a first stream of air and a second air exit opening for discharging a second stream of air;

a compressor housed within said housing, said compressor including an air inlet opening to receive the first stream of air flowing out of said first air exit opening of said air intake directing device, and said compressor being cooled by the second stream of air which flows out of said second air exit opening of said air intake directing device, the second stream of air then flowing out of said air outlet opening in said housing;

wherein said air intake directing device includes an air inlet opening, a first air flow channel between said air inlet opening and said first air exit opening, and a second air flow channel between said air inlet opening and said second air exit opening;

wherein at least one of said first air flow channel and said second air flow channel of said air intake directing device includes a restricted air flow passage at least partially created by a partition; and wherein at least one of said air inlet opening, said first air exit opening, said second air exit opening, and said restricted air flow passage of said air intake directing device is sized for controlling the quantity of air in the first stream of air and in the second stream of air.

7. A compressor system according to claim 1, wherein said air intake directing device is lined with sound absorbing material.

8. A compressor system according to claim 1, further comprising a tube connected to said first air exit opening of said air intake directing device and to said air inlet opening of said compressor.

9. A compressor system according to claim 8, further comprising an air filter in communication with said tube, such that air which flows out of said first air exit opening of said air intake directing device flows through said air filter before flowing into said air inlet opening of said compressor.

10. A compressor system according to claim 1, wherein said air intake directing device includes a set of baffles which define a non-linear flow path for the second stream of air which cools said compressor.

11. A compressor system comprising:

a housing having an air intake opening and an air outlet opening;

a first compartment within said housing;

a blower housed within said first compartment, said blower drawing air through said air intake opening of said housing, through said first compartment, and causing at least some of the air to exit out of said air outlet opening of said housing;

a second compartment within said housing, said second compartment including an air inlet opening which communicates with said air intake opening of said housing, and an air outlet opening, said blower drawing air into said air inlet opening of said second compartment, through said second compartment, and through said air outlet opening of said second compartment; and a compressor housed within said second compartment, said compressor being cooled by the air flowing through said second compartment.

12. A compressor system according to claim 11, wherein said second compartment is a substantially closed compartment, except for said air inlet opening and said air outlet opening provided therein, and wherein said air inlet opening and said air outlet opening in said second compartment are arranged so that the air flowing through said second compartment flows in a non-linear path.

13. A compressor system comprising:

a housing having an air intake opening and an air outlet opening;

a first compartment within said housing;

a blower housed within said first compartment, said blower drawing air through said air intake opening of said housing, through said first compartment, and causing at least some of the air to exit out of said air outlet opening of said housing;

a second compartment within said housing, said second compartment including an air inlet opening which communicates with said air intake opening of said housing, and an air outlet opening, said blower drawing air into said air inlet opening of said second compartment, through said second compartment, and through said air outlet opening of said second compartment;

a compressor housed within said second compartment, said compressor being cooled by the air flowing through said second compartment;

a heat exchanger housed within said first compartment and adjacent to said air intake opening of said housing, said blower drawing air through said heat exchanger to cool said heat exchanger;

an air plenum device housed within said first compartment, between said heat exchanger and said blower, said blower drawing air through said air plenum device; and a motor housed within said second compartment, said motor being operatively connected to said compressor, said motor being cooled by the air flowing through said second compartment.

14. A compressor system according to claim 13, wherein said air outlet opening said second compartment is an aperture provided in said air plenum device.

15. A compressor system comprising:

a housing having an air intake opening and an air outlet opening;

an air intake directing device within said housing to receive a stream of air flowing through said air intake opening of said housing, said air intake directing device including a first air exit opening for discharging a first stream of air and a second air exit opening for discharging a second stream of air;

a first compartment within said housing;

a blower housed within said first compartment, said blower drawing air through said air intake opening of said housing, through said first compartment, and causing at least some of the air which enter through said air intake opening of said housing to exit out of said air outlet opening in said housing;

a second compartment within said housing, said second compartment including an air inlet opening which communicates with said second air exit opening of said air intake directing device, and an air outlet opening, said blower drawing air out of said air intake directing device, through said second compartment, and through said air outlet opening in said second compartment; and a compressor housed within said housing, said compressor including an air inlet opening to receive the first stream of air flowing out of said first air exit opening of said air intake directing device, and said compressor being cooled by the second stream of air flowing through said second compartment.

16. A compressor system according to claim 15, wherein said air intake directing device is a box shaped enclosure which is removably mounted within said housing.

17. A compressor system according to claim 15, wherein said air intake directing device includes an air channel having at least one curved air flow path.

18. A compressor system according to claim 15, wherein said air intake directing device includes an air inlet opening, a first air flow channel between said air inlet opening and said first air exit opening, and a second air flow channel between said air inlet opening and said second air exit opening.

19. A compressor system according to claim 18, wherein at least one of said first air flow channel and said second air flow channel of said air intake chamber includes a restricted air flow passage.

20. A compressor system according to claim 19, wherein at least one of said air inlet opening, said first air exit opening, said second air exit opening, and said restricted air flow passage of said air intake directing device is sized for controlling how much air flows to said air inlet opening of said compressor and how much air cools said compressor.

21. A compressor system according to claim 15, wherein said air intake directing device is lined with sound absorbing material.

22. A compressor system according to claim 15, further comprising a tube connected to said first air exit opening of said air intake directing device and to said air inlet opening of said compressor.

23. A compressor system according to claim 22, further comprising an air filter in communication with said tube, such that air which flows out of said first air exit opening of said air intake directing device flows through said air filter before flowing into said air inlet opening of said compressor.

24. A compressor system according to claim 15, wherein said air intake directing device includes a set of baffles which define a non-linear flow path for the second stream of air which cools said compressor.

25. A compressor system according to claim 15, wherein said second compartment is a substantially closed compartment, except for said air inlet opening and said air outlet opening provided therein, and wherein said air inlet opening and said air outlet opening in said second compartment are arranged so that the air flowing through said second compartment flows in a non-linear path.

26. A compressor system according to claim 15, further comprising:

a heat exchanger housed within said first compartment and adjacent to said air intake opening of said housing, said blower drawing air through said heat exchanger to cool said heat exchanger;

an air plenum device housed within said first compartment, between said heat exchanger and said blower, said blower drawing air through said air plenum device; and a motor housed within said second compartment, said motor being operatively connected to said compressor, said motor being cooled by the air flowing through said second compartment.

27. A compressor system according to claim 26, wherein said air outlet opening in said second compartment is an aperture provided in said air plenum device.

28. A compressor system comprising:

a housing having an air intake opening and an air outlet opening;

an air intake enclosure within said housing, said air intake enclosure including an air inlet opening to receive a stream of air flowing through said air intake opening of said housing, a first flow channel between said air inlet opening and a first air exit opening, and a second flow channel between said air inlet opening and a second air exit opening;

a first compartment within said housing;

a blower housed within said first compartment, said blower drawing air through said air intake opening of said housing, through said first compartment, and causing at least some of the air to exit out of said air outlet opening in said housing;

a heat exchanger housed within said first compartment and adjacent to said air intake opening of said housing, said blower drawing air through said heat exchanger to cool said heat exchanger;

an air plenum device housed within said first compartment, between said heat exchanger and said blower, said blower drawing air through said air plenum device;

a substantially enclosed second compartment within said housing, said second compartment including an air inlet opening which communicates with said second air exit opening of said air intake enclosure, and an air outlet opening which is an aperture provided in said air plenum device, said blower drawing air out of said air intake enclosure, through said second compartment, and through said air outlet opening in said second compartment;

a compressor housed within said housing, said compressor including an air inlet opening to receive a stream of air flowing through said air intake enclosure and out of said first air exit opening of said air intake enclosure, said compressor being cooled by the air flowing through said second compartment;

a motor housed within said second compartment, said motor being operatively connected to said compressor, said motor being cooled by the air flowing through said second compartment; and a tube connected to said first air exit opening in said air intake enclosure and to said air inlet opening of said compressor.

29. A compressor system according to claim 28, wherein said air intake enclosure is removably mounted within said housing.

30. A compressor system according to claim 28, wherein each of said first air flow channel and said second air flow channel of said air intake enclosure includes at least one curved air flow path.

31. A compressor system according to claim 28, wherein at least one of said first air flow channel and said second air flow channel of said air intake enclosure includes a restricted air flow passage.

32. A compressor system according to claim 31, wherein at least one of said air inlet opening, said first air exit opening, said second air exit opening, and said restricted air flow passage of said air intake enclosure is sized for controlling how much air flows to said air inlet opening of said compressor and how much air cools said compressor.

33. A compressor system according to claim 28, wherein said air intake enclosure is lined with sound absorbing material.

34. A compressor system according to claim 28, further comprising an air filter in communication with said tube, such that air which flows out of said first air exit opening of said air intake enclosure flows through said air filter before flowing into said air inlet opening of said compressor.

35. A compressor system according to claim 28, wherein said air intake enclosure includes a set of baffles which define a non-linear flow path for the second stream of air which cools said compressor.

* * * * *